US006536656B2

(12) United States Patent
Auclair et al.

(10) Patent No.: US 6,536,656 B2
(45) Date of Patent: Mar. 25, 2003

(54) CARTON AND A HANDLE THEREFOR

(75) Inventors: Jean-Michel Auclair, Chateauroux (FR); Patrick Blin, Chateauroux (FR)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 10/046,400

(22) Filed: Jan. 14, 2002

(65) Prior Publication Data

US 2002/0079245 A1 Jun. 27, 2002

Related U.S. Application Data

(63) Continuation of application No. PCT/US00/19008, filed on Jul. 13, 2000.

(51) Int. Cl.[7] ..... B65D 5/46; B65D 75/08

(52) U.S. Cl. ..... 229/117.13; 206/427; 229/920

(58) Field of Search ..... 229/117.12, 117.13, 229/117.23, 117.24, 920; 206/140, 141, 427, 434

(56) References Cited

U.S. PATENT DOCUMENTS

| | | | | | |
|---|---|---|---|---|---|
| 2,171,615 | A | | 9/1939 | Wesselman | 206/195 |
| 3,640,448 | A | * | 2/1972 | Wood | 206/434 |
| 4,314,634 | A | * | 2/1982 | Stone | 229/117.12 |
| 4,440,340 | A | * | 4/1984 | Bakx | 206/427 |
| 4,463,852 | A | | 8/1984 | Stone | 206/427 |
| 4,498,582 | A | * | 2/1985 | Tomassi et al. | 206/427 |
| 5,221,041 | A | * | 6/1993 | Stout et al. | 229/117.13 |
| 5,379,944 | A | | 1/1995 | Stout et al. | 229/117.13 |
| 5,385,234 | A | * | 1/1995 | Stout et al. | 229/117.13 |
| 5,480,091 | A | | 1/1996 | Stout | 229/117.14 |
| 5,611,431 | A | * | 3/1997 | Harris | 206/434 |
| 5,772,030 | A | * | 6/1998 | Baxter | 229/117.13 |
| 5,996,883 | A | * | 12/1999 | Bates | 229/117.13 |

FOREIGN PATENT DOCUMENTS

| | | |
|---|---|---|
| WO | 96/21603 | 7/1996 |
| WO | 96/21604 | 7/1996 |

* cited by examiner

*Primary Examiner*—Gary E. Elkins
(74) *Attorney, Agent, or Firm*—Tsugihiko Suzuki

(57) ABSTRACT

A carton and blank for forming a carton for packaging a plurality of articles, for example bottles, comprises a plurality of panels for forming a tubular structure including a top wall panel having opposed side edges and end edges. The top panel is provided with first and second spaced apertures provided therein so as to define a handle, and a score line extends from the handle to a cut line disposed along a side edge of the top wall panel thereby to direct lifting stresses away from the handle.

31 Claims, 4 Drawing Sheets

CARTON AND A HANDLE THEREFOR

This is a continuation of international application No. PCT/US00/19008, filed Jul. 13, 2000, which is hereby incorporated by reference.

BACKGROUND OF THE INVENTION

The present invention relates generally to paperboard carton blanks for use in packaging articles. It is particularly useful for cartons for packaging containers, for example cans or bottles for beverages, although the invention is not limited in this regard. More particularly, the invention relates to a handle for such cartons.

Containers, for example cans or bottles for beverages including soft drink, beer, juices and the like are commonly sold in multiple quantities packaged in a paperboard carton. For the convenience of the consumer, the carton is often provided with a handle, which quite commonly includes as a primary feature one or two slots or other apertures formed in the carton. These slots are commonly formed into a top wall of the carton. The user inserts the hand or fingers into one or both of the slots to lift the carton. Many varieties of handles of this type are known in the art.

Lifting a carton containing beverage cans or bottles introduces considerable stress into the paperboard from which the carton is formed. For this reason, and to prevent tearing of the paperboard and failure of the carton, a large number of carton handles have been devised over the years which include various reinforcement structures, aperture arrangements and locations, stress-directing fold lines, stress-relieving slits and the like.

Recently, attempts have been made to introduce into the marketplace beverage cartons wherein cans are arranged in two tiers, with corresponding cans from each tier being axially aligned. An example of such a carton can be seen by reference to U.S. Pat. No. 5,427,242. Such cartons are intended to hold relatively large numbers of cans, for example 24 to 36 cans. The contained weight of these cartons makes use of reinforced handle structures particularly advantageous.

Moreover, despite the many handle designs which have been previously developed, there is always a need for handles with improved performance. A stronger handle may permit the use of larger cartons for packaging heavier loads, as well as the possibility of a smaller blank or lighter paperboard material. In view of the large numbers of cartons which are produced, the cost savings which can be realised from these latter advantages can be significant.

The present invention and its preferred embodiment seeks to overcome or at least mitigate the problems of the prior art.

SUMMARY OF THE INVENTION

One aspect of the invention provides a carton for packaging a plurality of articles, for example bottles comprising a plurality of panels for forming a tubular structure including a top wall panel having opposed side edges and end edges. The top wall panel is provided with a handle. A score line extends from the handle to a cut line disposed along a side edge of the top wall panel thereby to direct lifting stresses away from the handle.

According to an optional feature of this aspect of the invention the handle may comprise first and second spaced apertures defining a handle panel.

According to another optional feature of this aspect of the invention there may further comprises a second score line extending from an edge of the first hand aperture to the cut line and spaced from the first fold line to define a part of the top wall that is capable of flexing relative the top wall, thereby to direct the lifting stresses away from the handle and/or absorb said lifting stresses.

A second aspect of the invention provides a blank for forming a carton for packaging a plurality of articles, for example bottles comprising a first side wall panel, a top wall panel having opposed side edges and end edges, a second side wall panel and a base panel hingedly connected together in series, wherein the top panel having first and second spaced apertures provided therein so as to define a handle panel wherein a score line extends from the handle to a cut line disposed along a side edge of the top wall panel.

According to an optional feature of either aspect of the invention, the score line may terminate intermediate the ends of the side edge cut line. Optionally, the score line may diverge away from a linear path so as to intersect with the side edge cut line.

According to an optional feature of the second aspect of the invention, there may further comprises a second score line extending from an edge of the first hand aperture to the cut line and spaced from the first fold line to define a part of the top wall panel that is capable of being moved out of the plane of the top wall in use.

According to another optional feature of either aspect of the invention, at least one frangible line may extend from the first aperture to detachably connect the handle to the top wall panel and wherein the or each score line extends from a first frangible line.

Optionally, each/or frangible line may curve inwardly before terminating.

According to a further optional feature of either aspect of the invention, the second score line may extend from a location on the aperture cut line proximate the intersection of the aperture with the frangible line. Alternatively, the second score line may extend from an edge of the aperture.

According to yet another optional feature of either aspect of the invention, on one side of the handle, there may comprise opposed frangible lines extending from the bandle and a second flexing part, wherein the second flexing part is defined by a third score line extending from the second frangible line to a second side edge cut line provided on the side edge, and a fourth score line extending from the aperture edge to an end of the second side edge cut line. Preferably, a portion of each of the second and the fourth score lines may be arranged to be co-extensive.

More preferably, the other side of the handle may comprises opposed frangible lines extending from the handle and a pair of flexing parts extending between the handle and hand aperture and a pair of spaced cut lines struck from at he opposed side edge, wherein the pair of cut lines and the first and second cut lines are located in different relative longitudinal positions on the opposed side edges.

According to a still further optional feature of this aspect of the invention, the or each side edge cut line may form part of article receiving structure comprising opposed hingable flaps separated by a further cut line extending substantially perpendicular to the side edge cut line.

A third aspect of the invention provides a handle structure for a carton for packaging a plurality of articles, for example bottles comprising a top wall panel having opposed side edges and end edges the top panel having first and second spaced apertures provided therein so as to define a handle. A score line extends from the handle to a cut line disposed along a side edge of the top wall panel and a second score line extending from an edge of the first hand aperture to the cut line and spaced from the first fold line to define a part of the top wall that is capable of flexing relative the top wall, thereby to direct the lifting stresses away from the handle and/or absorb said lifting stresses.

A fourth aspect of the invention provides a carton for packaging four or more rows of articles for example bottles, which carton comprises a plurality of panels for forming a tubular structure including opposed first and second side wall panels, wherein the first and second side wall panels each comprises a pair of apertures to receive and retain a part of an article, the first and second apertures of the first side wall engage an outermost article from a first row and a second row, and third and fourth apertures of the second side wall panel engage an outermost article from a third row and fourth row.

Optionally, the first row may be adjacent the second row so that the first and second apertures are adjacent each other. Preferably, the third and fourth rows may be separated by the first and second rows. Alternatively, the first and second apertures may be provided for the two centrally located articles in adjacent rows while the third and fourth apertures are provided for two off-center articles in the adjacent row.

According to an optional feature of the fourth aspect of the invention each aperture may be defined by one or more side opening flaps hingedly connected to the first or second side wall panels and adapted to articulate outwardly by an article present in the aperture.

BRIEF DESCRIPTION OF THE DRAWINGS

Exemplary embodiments will now be described, by way of example only, with reference to the accompanying drawings in which.

DETAILED DESCRIPTION OF THE PREFERRED EMBODIMENTS

Figure 1:
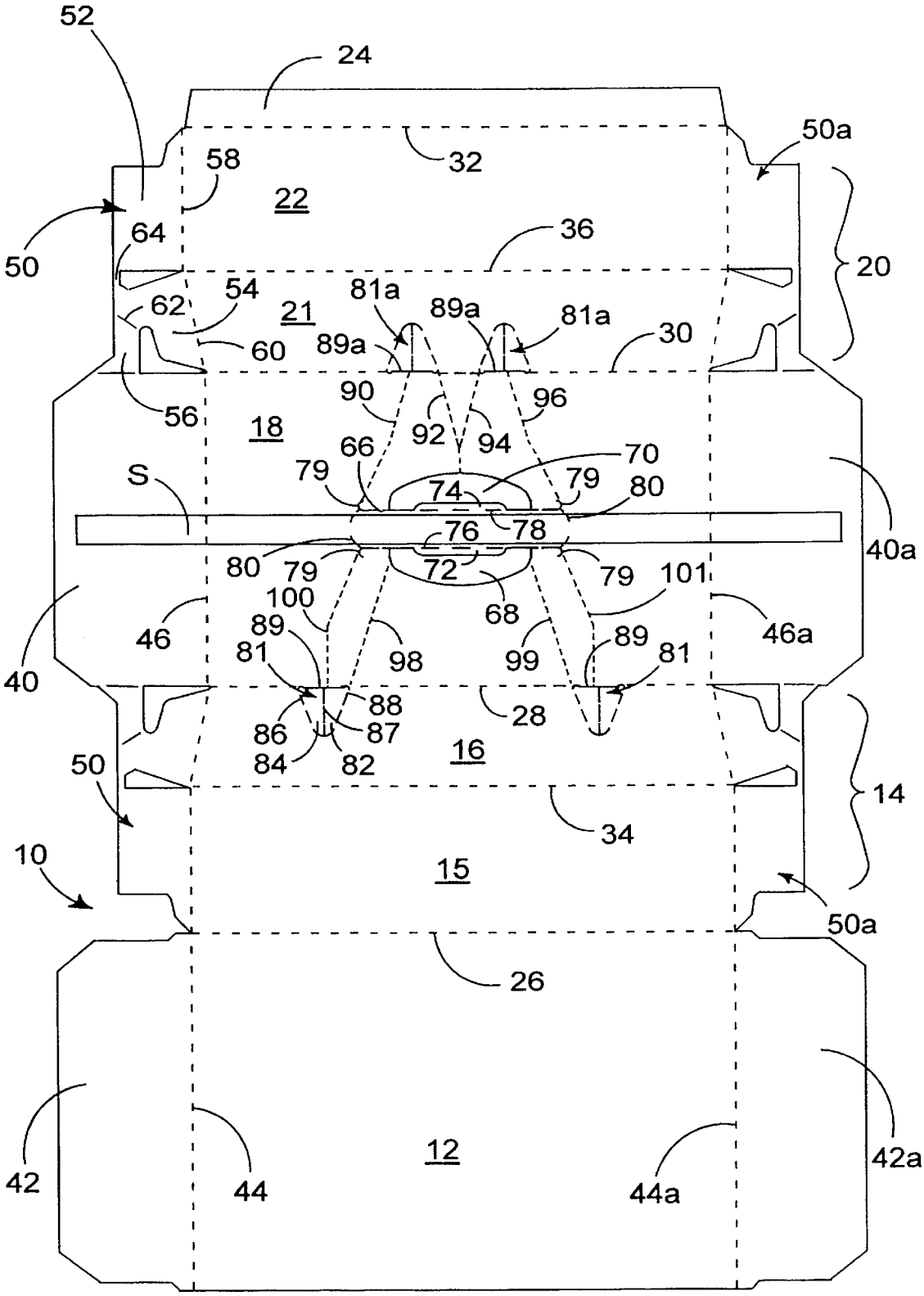
FIG. 1 is a plan view of the inner surface of a blank for forming a carton having a handle arrangement according to one aspect of the present invention.

Referring to the drawings, and in particular to FIG. 1, there is shown a blank 10 for forming a carton formed from paperboard or other suitable foldable sheet material. The blank 10 comprises a plurality of panels for forming a tubular structure: in this embodiment there comprises a base wall panel 12, a side wall panel 14, a top wall panel 18 and a second side wall panel 20 hingedly connected together along fold lines 26, 28 and 30 respectively. In this embodiment, the side wall panels 14 and 20 are arranged into upper parts 16, 21 and lower parts 15, 22. It will be seen from FIG. 1 that the upper part 16 is hingedly connected to the lower part IS of side wall 14 along fold line 34. Likewise, upper part 21 is hingedly connected to lower part 22 along fold line 36. There may further comprise securing flap 24 hingedly connected to side wall panel 20 along fold line 32.

Optionally, end walls are provided at the opposing ends of the tubular structure and, on one side of the tubular structure there comprises upper and lower end wall panels 40, 42 hingedly connected to top wall panel 18 and base wall panel 12 respectively along to fold lines 46 and 44. There may further comprise one or more gusset panel structures 50, to assist in forming one or both of the end walls. Each gusset panel structure 50, is substantially the same and so only one such structure 50 will now be described in further detail below.

The gusset panel structure 50 comprises lower gusset panel 52 hingedly connected to lower side wall panel 22 along fold line 58 and intermediate gusset panel 54 hingedly connected to upper side panel 21 along fold line 60. A connecting portion 64 connects gusset panels 52 and 54, but they are otherwise separated from each other by an aperture. There may further comprise upper gusset panel 56 hingedly interconnecting upper end wall panel 40 and intermediate gusset panel 54 along fold line 62 and an extension of fold line 30 respectively. To assist in folding, fold line 62 is preferably configured to converge at the intersection of fold lines 30 and 60.

It will be apparent from FIG. 1 that the opposing end wall structure is substantially the same as that described above and therefore like reference numerals are employed with the addition of the letter "a".

Turning to the handle structure, a handle is provided in the top wall panel 18 which in one class of embodiments includes a pair of hand apertures 68 and 70 positioned either side of a handle panel 66. The apertures are generally oval in shape to receive a user's hand, although other shapes could be employed according to user requirements.

Preferably the handle panel 66 is frangibly connected to top panel 18 along frangible lines 80 along a portion of each side edge but is otherwise separated from the top wall by the hand apertures 68, 70. The frangible lines 80 preferably curve inwardly before terminating. In this embodiment, the handle panel 66 is elongate, although it is envisaged that the handle shape could be altered to the preferred user requirement. At the location in which the frangible lines 80 deviate from their straight path, there are preferably provided stress relief cut lines 79 which curve back outwardly through substantially 180°.

There may further comprise a reinforcing strap "S" secured to opposing upper end wall panels 40 and 40*a* and the strip is also secured to the handle panel 66 by glue or other suitable means known in the art. There may further comprise a cushion flap 72 disposed along the inner side edge of aperture 68 and connected to the handle panel 66 by fold line 76. A similar cushion flap 74 may be provided, which is connected to opposing side edge of handle panel 66 along fold line 78. It will be recognised that in the completed carton fold lines 76 and 78 will, preferably, lie substantially on the side edges of the underlying reinforcing strap "S".

A plurality of article receiving arrangements 81, 81*a* are optionally provided for receiving and/or engaging an article which arrangements 81, 81*a* are struck from the upper side panels 16 and 21 respectively. The article receiving arrangements 81, 81*a* are substantially the same and only one arrangement shall therefore be described in any greater detail. It will be seen from FIG. 1 that the article receiving arrangement 81 comprises a pair of article receiving panels 82 and 84 struck from upper side wall panel 16 and hingedly connected thereto along divergent fold lines 86 and 88 respectively. The panels 82 and 84 may be substantially triangular in shape and are separated from the blank by a pair of cut lines 87, 89 to allow the panels 82, 84 to articulate about the fold lines 86, 88 to define a retaining aperture. One of the cut lines 89 preferably overlies fold line 28 and terminates with curved portions to provide some stress relief.

In other embodiments, no article receiving arrangements are provided, although to assist in dissipating the stresses from the handle, cut line 89, 89*a* may be provided along one or more edges of the top wall.

Figure 2:
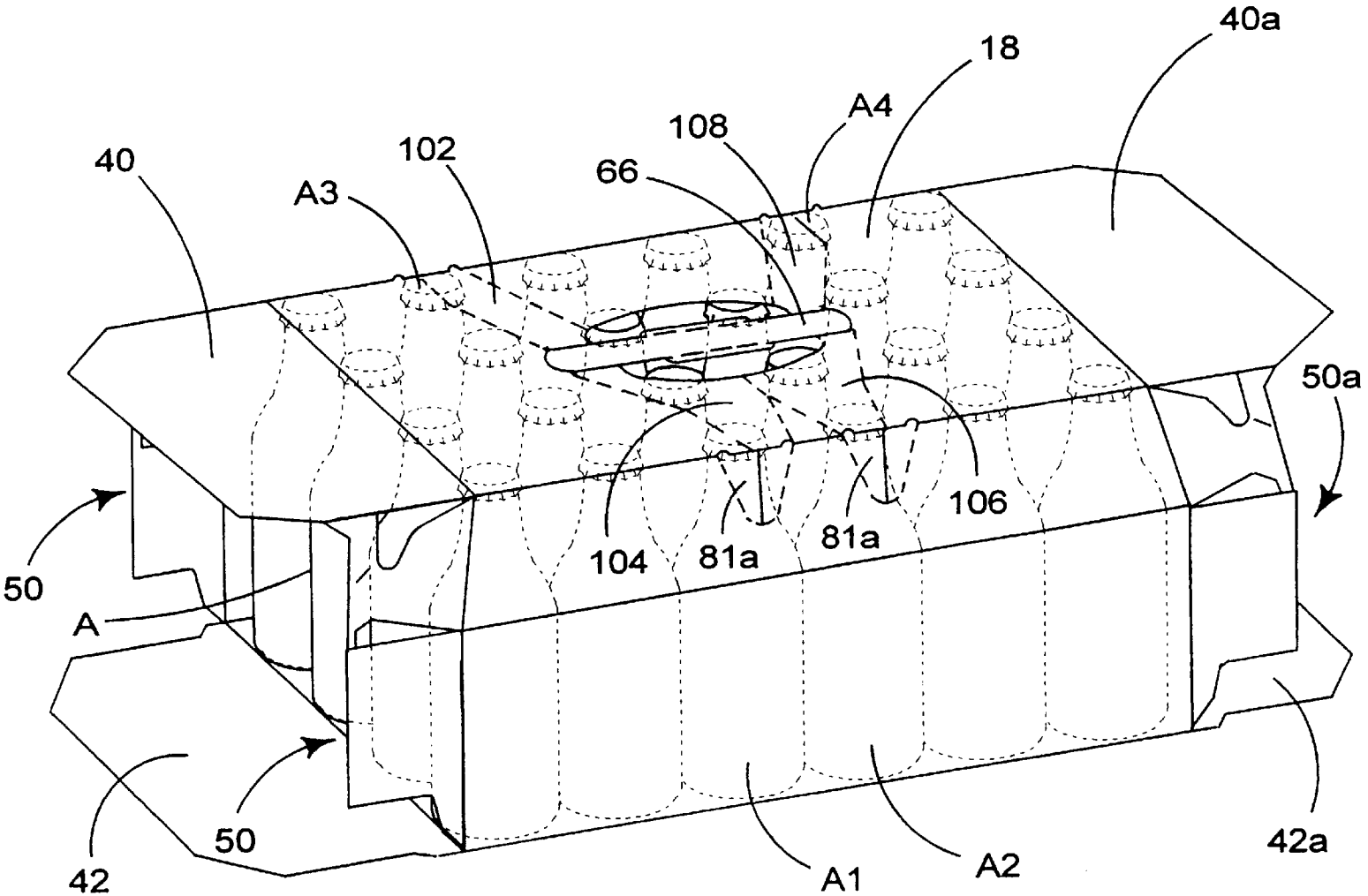
FIG. 2 is a perspective view showing a first step in the formation of a carton from the blank of FIG. 1.
Figure 4:
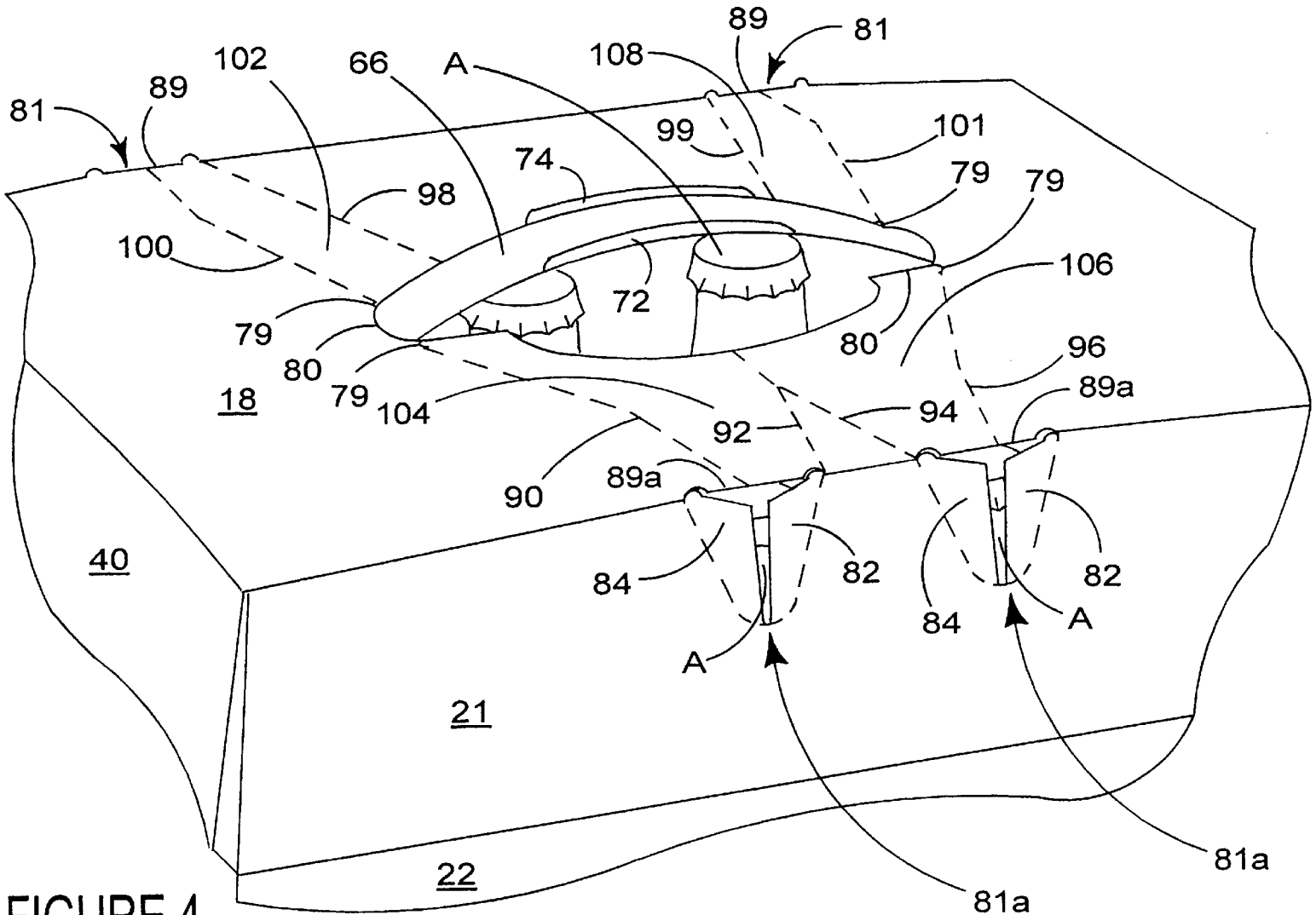
FIG. 4 shows an enlarged view of the top panel portion of the carton shown in FIG. 3.

Each article receiving arrangement 81, 81*a* is configured to receive an outermost article from one of the rows as shown in FIGS. 2 and 4, whereby panels 82, 84 are folded in an outward direction by abutment with an upper part of the article received in the resulting retaining aperture. Preferably, the configuration is for the article receiving arrangements 81*a* on one side of the top wall 18 to receive two adjacent articles A1, A2, for example third and fourth row and for the article receiving arrangements 81 on the other upper side wall to receive articles from different rows A3, A4 for example second and fifth rows in FIG. 2.

A plurality of stress-diverting score lines are formed in the top wall panel 18. On one side of the carton with the article receiving arrangements 81*a* in adjacent positions, there comprises a score line 90 extending from the handle panel 66 and terminating along the cut line 89*a* forming one of the article receiving arrangements 81*a;* preferably, intermediate the ends of the cut line 89*a*. In this embodiment, score line 90 preferably comprises two straight portions angled obtusely to each other. There may further comprise a second score line 96 extending from the opposing end of handle panel 66 and terminating at the cut line 89*a* following an edge of the other article receiving arrangement 81*a* formed from the upper side panel 21. In this embodiment, there further comprises a pair of score lines 92, 94 which extend from the ends of cut lines 89*a* and converge at a point adjacent a central portion of aperture 70 and terminate at the outer edge thereof.

The opposing side of the top panel further comprises a plurality of stress diverting score lines, however, as the article receiving arrangements are spaced further apart, the score lines are configured differently. Score line 100 extends from the end of handle panel 66 and terminates at cut line 89 of aperture receiving arrangement 81. Score line 100 preferably comprises two straight portions with an obtuse angle therebetween such that the score line 100 intersects the cut line 89 of one of the article receiving apertures 81 substantially perpendicular thereto. A second score line 98 preferably extends from fold line 88 to terminate at an outer edge of aperture 68. Similarly, a second pair of score lines 99, 101 connects the other article receiving arrangement 81 with the handle panel 66 and aperture 68 respectively.

The shape and configuration of the score lines is not limited to that described above and it is envisaged that other arrangements could be employed. However, each pair of adjacent score lines should be shaped to define a part 102, 104, 106, 108 of the top wall panel 18 shown in FIGS. 3 and 4 that can flex and/or bow relative the top and/or side walls of the carton, thereby to transmit, direct and/or absorb lifting stresses from the handle.

Figure 3:
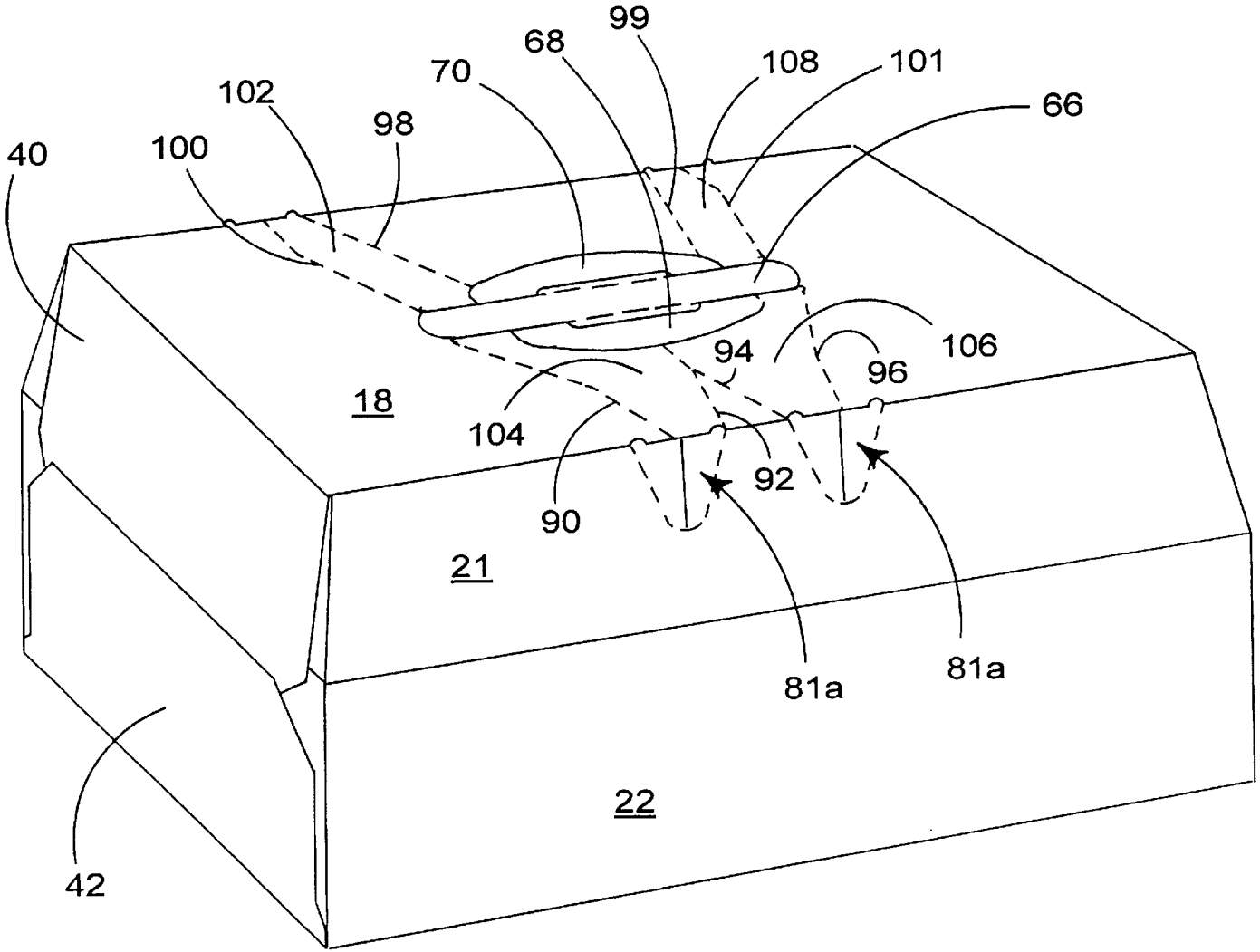
FIG. 3 shows the end closure structure sealed to form the completed carton.

Turning to the construction of the carrier illustrated in FIGS. 2 and 3, it is envisaged that the carton of the present invention can be formed by a series of sequential folding and gluing operations which can be performed in a straight line machine so that the carton is not required to be rotated or inverted to complete its construction. The folding process is not limited to that described below and can be altered according to particular manufacturing requirements.

Referring now to FIG. 2, the carton can be seen in a tubular state formed from the blank 10. The handle reinforcing strap S is secured to the carton and the securing flap 24 is secured to base panel 12 by glue or other suitable means known in the art.

The carton C is shown with its end closure structure, comprising upper end wall panels 40 and 40*a* and lower end wall panels 42 and 42*a,* open so that the carton is loaded from one or both ends with articles "A", as shown here for example, with beverage bottles arranged into a single tier. Articles "A" are positioned on the bottom wall panel 12 of the carton 10. Such a loading operation may be carried out by suitable, commercially-available automated packaging machinery.

Closure of the end closure structure is preferably effected in the following manner. Upper end wall panels 40 is folded to a closed position against the packaged articles A, by folding gusset panel structures 50 inwardly. Glue is applied to lower end wall panel 42 and lower end wall panel 42 is then folded upwardly and secured to the upper end wall panel 40.

An identical operation is carried out to close the end closure structure located at the opposite end of the carton. (In a preferred embodiment of the invention, the carton is loaded from one end only using automated packaging machinery. During such a loading operation, the opposite, non-loaded carton end is closed and sealed before the bottles are pushed into the carton). The carton in its fully constructed and loaded condition is shown in FIG. 3.

The handle arrangement formed in top wall panel 18 may be seen in greater detail by reference to FIG. 4. In use, when lifting the loaded carton for the first time, a user inserts the hand and/or fingers into one or both of the apertures 68 and 70 and grasps the portion of panel 66 therebetween. The user then lifts the carton C. The weight of the carton causes the lifting to separate the handle panel 66 from the top wall panel along the frangible lines 80 and thereafter to deflect the tearing stress along score lines 90, 92, 94, 96, 98, 100 toward the article receiving arrangements 81. This effectively converts tearing stress in the handle region to tensile stress along the score lines. Thus, those parts 102, 104, 106, 108 of the top wall between the above mentioned fold lines are allowed to flex and/or bow.

In the specific embodiment disclosed, a specific location for each article receiving arrangement is shown. However, the receiving arrangements may be located adjacent other articles within the article grouping, and the position of the score lines changed accordingly, within the scope of the invention.

It will also be recognised that it is possible to use the handle of the present invention with a carton having "bevelled" comers.

Lifting of the carton causes the handle panel 66 in its central region to bow upwardly, and is supported by the two-ply reinforced strap "S". Therefore, the frangible lines may tear to allow the handle panel 66 to protrude above the top wall panel 18. The curved stress relief lines 79 also assist in preventing the tearing from extending beyond frangible line 80. Because tearing in the top panel is controlled, overall tear-resistance is in fact improved. Not only is the handle of improved strength, but it also provides a comfortable "feel" for the user while lifting and/or carrying the carton.

It should be readily recognised that while in the preferred embodiment, the present invention has been described in connection with a carton for packaging bottles, the handle structure may also be used with a carton for packaging two tiers of bottles, or for a carton for packaging cans, jars or other containers or articles. The containers may be oriented vertically, as described herein, or horizontally.

Further, it should be recognised that various handle reinforcing means other than that described herein may be used with the disclosed handle. For example, rather than a single top panel 18 and the reinforcing structure comprising strap "S", a lapped top panel of a type generally known in the art may be used. In such an embodiment, the overlap between the two top panel portions forms a double-ply strip which extends down the centre of the carton top wall. An example of a carton of this type may be seen in U.S. Pat. No. 5,427,242, which is incorporated herein by reference. The handle structure is formed into the lapped top panel in the same manner as the handle structure described herein, as will be readily appreciated by those skilled in the art. In such an embodiment, the frangible lines 80 are formed to extend along the edges of the lapped portion.

It will also be recognised that as used herein, directional references such as "top", "base", "end", "side", "upper", "intermediate" and "lower" do not limit the respective panels to such orientation, but merely serve to distinguish these panels one from another. Any reference to hinged connection should not be construed as referring to a single fold line, indeed it is envisaged that a hinged connection can be formed from, a score line, a frangible line, or one, two or more fold lines without departing from the scope of invention.

What is claimed is:

1. A carton for packaging a plurality of articles, comprising a plurality of panels for forming a tubular structure including a top wall panel having opposed side edges and end edges, the top wall panel having a handle, wherein a first score line extends from the handle to a cut line disposed along one of the side edges of the top wall panel thereby to direct lifting stresses away from the handle, and wherein the cut line is aligned with the one side edge of the top wall panel.

2. The carton as claimed in claim 1 wherein the score line terminates intermediate the ends of the side edge cut line.

3. The carton as claimed in claim 1 wherein the score line comprises two straight portions with an obtuse angle therebetween such that one of the two straight portions intersects with the side edge cut line.

4. The carton as claimed in claim 1 wherein the handle comprises first and second spaced hand apertures defined in the top wall panel, the first and second hand apertures defining therebetween a handle panel.

5. The carton as claimed in claim 4 wherein there further comprises a second score line extending from an edge of the first hand aperture to the cut line and spaced from the first score line to define a first flexing part of the top wall panel that is capable of flexing relative the top wall panel, thereby to direct the lifting stresses away from the handle and/or absorb said lifting stresses.

6. The carton as claimed in claim 5 wherein a first frangible line extends from the first hand aperture to detachably connect the handle to the top wall panel and wherein the first score line extends from the first frangible line.

7. The carton as claimed in claim 6 wherein the first frangible line curves inwardly before terminating.

8. The carton as claimed in claim 6 wherein the second score line extends from a location proximate the intersection of the first hand aperture with the first frangible line.

9. The carton as claimed in claim 6 wherein the second score line extends from an edge of the first hand aperture.

10. The carton as claimed in claim 5 wherein on one of opposite sides of the handle, there comprises opposed frangible lines extending from the handle and a second flexing part, wherein the second flexing part is defined by a third score line extending from one of the (frangible lines to a second side edge cut line provided on the one side edge, and a fourth score line extending from the first hand aperture to an end of the second side edge cut line.

11. The carton as claimed in claim 10 wherein the second and the fourth score lines are arranged to be partially co-extensive with each other.

12. The carton as claimed in claim 10 wherein on the other of the opposite sides of the handle, there further comprises opposed frangible lines extending from the handle and a pair of flexing parts extending between the handle and a pair of spaced cut lines at the opposed side edge, and wherein the pair of cut lines and the first and second cut lines are located in different relative longitudinal positions on the opposed side edges.

13. The carton according to claim 1 wherein the side edge cut line forms part of an article receiving structure comprising opposed hingable flaps separated by a further cut line extending substantially perpendicular to the side edge cut line.

14. The carton as claimed in claim 1 wherein the cut line is spaced from the end edges of the top wall panel and terminates with curved portions to provide stress relief.

15. A blank for forming a carton for packaging a plurality of articles, comprising a first side wall panel, a top wall panel having opposed side edges and end edges, a second side wall panel and a base panel hingedly connected together in series, wherein the top wall panel has first and second spaced hand apertures provided therein so as to define a handle panel, wherein a first score line extends from the handle to a cut line disposed along one of the side edges of the top wall panel, and wherein the cut line is aligned with the one side edge of the top wall panel.

16. The blank according to claim 15 wherein the score line terminates intermediate the ends of the side edge cut line.

17. The blank as claimed in claim 15 wherein the score line comprises two straight portions with an obtuse angle therebetween such that one of the two straight portions intersects with the side edge cut line.

18. The blank as claimed in claim 15 wherein there further comprises a second score line extending from an edge of the first hand aperture to the cut line and spaced from the first score line to define a first flexing part of the top wall panel that is capable of flexing relative the top wall panel.

19. The blank as claimed in claim 18 wherein a first frangible line extends from the first hand aperture to detachably connect the handle to the top wall panel and wherein the first score line extends from the first frangible line.

20. The blank as claimed in claim 19 wherein the first frangible line curves inwardly before terminating.

21. The blank as claimed in claim 19 wherein the second score line extends from a location proximate the intersection of the first hand aperture with the first frangible line.

22. The blank as claimed in claim 19 wherein the second score line extends from an edge of the first hand aperture.

23. The blank as claimed in claim 18 wherein on one of opposite sides of the handle, there comprises opposed frangible lines extending from the handle and a second flexing part, wherein the second flexing part is defined by a third score line extending from one of the frangible lines to a second side edge cut line provided on the one side edge, and a fourth score line extending from the first hand aperture to an end of the second side edge cut line.

24. The blank as claimed in claim 23 wherein the second and the fourth score lines are arranged to be partially co-extensive with each other.

25. The blank as claimed in claim 22 wherein on the other of the opposite sides of the handle, there further comprises opposed frangible lines extending from the handle and a pair of flexing parts extending between the handle and a pair of spaced cut lines at the opposed side edge, and wherein the pair of cut lines and the first and second cut lines are located in different relative longitudinal positions on the opposed side edges.

26. The blank according to claim 15 wherein the side edge cut line forms part of an article receiving structure comprising opposed hingable flaps separated by a further cut line extending substantially perpendicular to the side edge cut line.

27. A handle structure for a carton for packaging a plurality of articles, comprising: a top wall panel having opposed side edges and end edges, the top wall panel having first and second spaced hand apertures provided therein so as to define a handle wherein a score line extends from the handle to a cut line disposed along one of the side edges of the top wall panel and a second score line extending from an edge of the first hand aperture to the cut line and spaced from the first score line to define a part of the top wall panel that is capable of flexing relative the top wall panel, thereby to direct the lifting stresses away from the handle and/or absorb said lifting stresses, and wherein the cut line is aligned with the one side edge of the top wall panel.

28. A carton for packaging four or more rows of articles, comprising a plurality of panels for forming a tubular structure including opposed first and second side wall panels, wherein the first side wall panel has only two apertures to receive and retain respective ones of the articles from first and second ones of the four or more rows, wherein the second side wall panel has only two apertures to receive and retain respective ones of the articles from third and fourth ones of the four or more rows.

29. The carton as claimed in claim 28 wherein the first row is adjacent the second row so that the two apertures of the first side wall panel are adjacent each other.

30. The carton as claimed in claim 29 wherein the third and fourth rows are separated by the first and second rows.

31. The carton as claimed in claim 28 wherein each aperture is defined by one or more side opening flaps hingedly connected to the first or second side wall panel and adapted to articulate outwardly by the respective article present in the each aperture.

* * * * *